US005359231A

United States Patent [19]

Flowers et al.

[11] Patent Number: 5,359,231

[45] Date of Patent: Oct. 25, 1994

[54] WALLBOX-MOUNTABLE SWITCH AND DIMMER

[75] Inventors: Woodie C. Flowers, Weston, Mass.; James R. Graybill, Jr., Emmaus, Pa.; Elliot G. Jacoby, Jr., Glenside, Pa.; John E. Longenderfer, Orefield, Pa.; Joel S. Spira, Coopersburg, Pa.

[73] Assignee: Lutron Electronics Co., Inc., Coopersburg, Pa.

[21] Appl. No.: 48,714

[22] Filed: Apr. 16, 1993

Related U.S. Application Data

[63] Continuation of Ser. No. 719,223, Jun. 21, 1991, Pat. No. 5,262,678.

[51] Int. Cl.[5] ..... H01C 10/38

[52] U.S. Cl. ..... 307/125; 307/139; 338/176; 338/178; 200/335; 315/295

[58] Field of Search ..... 307/125, 112, 115, 130, 307/131, 135, 139-141, 141.4; 174/53-58; 338/68, 178, 179, 199, 200; 315/297, 295; 200/330, 335

[56] References Cited

U.S. PATENT DOCUMENTS 4,939,383 7/1990 Tucker et al. ..... 307/139

OTHER PUBLICATIONS

Home Automation Limited, Jan. 1984, p.2 "Slider Dimmer" SC 630W 1D.

*Primary Examiner*—A. D. Pellinen
*Assistant Examiner*—Aditya Krishnan
*Attorney, Agent, or Firm*—Warren W. Kurz

[57] ABSTRACT

A wallbox-mountable system for controlling electrical power to a load is disclosed. The system comprises a yoke, a frame, a toggle switch and at least one slidable lever. The yoke has an opening which is completely occupied by the frame member and the frame member has at least one channel. The toggle switch has a its handle extending through the frame and has one end mechanically coupled to a means for turning power on and off to a load. The slidable lever extends through the channel and is mechanically coupled to a means for adjusting the power to a load.

7 Claims, 7 Drawing Sheets

WALLBOX-MOUNTABLE SWITCH AND DIMMER

This is a continuation of pending application Ser. No. 07/719,223, filed Jun. 21, 1991.

FIELD OF THE INVENTION

This invention relates to a switch/dimmer assembly that provides for both ON-OFF switching and dimming control for electrical power applied to a load. In an alternative embodiment, the invention provides for both three-way switching and dimming control for electrical power to a load such as a lamp.

DESCRIPTION OF THE RELATED ART

Light dimmers having ON-OFF switching capabilities are well-known and one such dimmer is described in U.S. Pat. No. 4,259,619 of Wall issued Mar. 31, 1981. The '619 patent discloses a dimmer switch having a single actuator with FULL, DIM, and OFF positions for controlling the brightness of lamps. The FULL position turns the lights ON at full brightness, whereas, the OFF position turns the lights OFF. The DIM position has a range of movement that is responded to by a dimming circuit to control the brightness of a lamp. In practice, it is desired that the dimming of the lamp have a preset condition that remains undisturbed. The single actuator of the '619 patent does not provide for the ability to separately control the ON-OFF state of the lamp while at the same time allowing the preset dimmer condition of the lamp to remain undisturbed.

U.S. Pat. Nos. 4,520,306 and 4,564,801 both of Kirby, respectively issued May 28, 1985 and Jan. 14, 1986, both disclose a single dimmer switch having a rotatable shaft for dimming a load and wherein the shaft is depressible to accomplish the ON-OFF switching of the load.

A switch assembly mounted in a wallbox is disclosed in U.S. patent application Ser. No. 07/871,876 of Rowen et al. filed Apr. 21, 1988, assigned to the assignee of the present invention, and is herein incorporated by reference. U.S. application Ser. No. 07/871,876 discloses an assembly having a short throw light force switch for controlling ON-OFF switching and a linear slide control for dimming. The relative size of the push button switch predominates over the size of a linear dimmer slider which is advantageous from human factor considerations. Although the wall-mountable switch and dimmer of Ser. No. 07/225,457 serves well its intended purpose, further improvements to the assembly can be made to adapt it for use with standard toggle switch faceplate openings.

Accordingly, it is an object of the present invention to provide a wall-mountable dimmer switch assembly having an arrangement that is particularly suited to provide control of both the ON-OFF and dimming functions for a load.

It is a further object of the present invention to provide for a dinner assembly that controls the ON-OFF switching while at the same time does not disturb a preset dimming condition for the lamp.

SUMMARY OF THE INVENTION

The present invention is directed to a dimmer switch assembly that may be arranged to provide for control of both the ON-OFF switching and dimming of a lamp.

In one embodiment, a wallbox-mountable system for controlling electrical power to a load comprises a yoke having an opening located in correspondence with a central opening of a wallbox faceplate, a toggle switch, and at least one movable lever. It is preferred that a frame member be also included in the system. The toggle switch and movable lever are located in a side-by-side arrangement with the toggle switch and movable lever moving in a vertical direction. The yoke has an opening corresponding to a standard opening of the faceplate and which is completely occupied by the frame member having at least one channel. The toggle switch includes a handle having one end extending through the opening and the other end of its handle mechanically coupled to means for turning power ON and OFF to the load. The movable lever extends through and is movable within the opening of the yoke and has one end for holding that extends out of the channel and its other end mechanically coupled to means for adjusting the amount of power supplied to the load.

In another embodiment, the wallbox-mountable system has two movable levers, one on each side of the toggle switch.

In a further embodiment, a wallbox-mountable system, particularly suited for energy-management applications, the movable lever does not pass through the frame, rather, the channel of the frame provides a passageway for inserting a tool to adjust the movable lever, and hence, the amount of power supplied to the load.

In a further embodiment the channel of the frame has a removable plug to prevent access to the movable lever when the plug is inserted.

Other objects, advantages and novel features of the present will become apparent from the following detailed description of the invention when considered in conjunction with the accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

The present invention provides a switch and dimmer assembly that is particularly suited for accomplishing both ON-OFF switching and dimming for electrical loads such as lamps.

Figure 1:
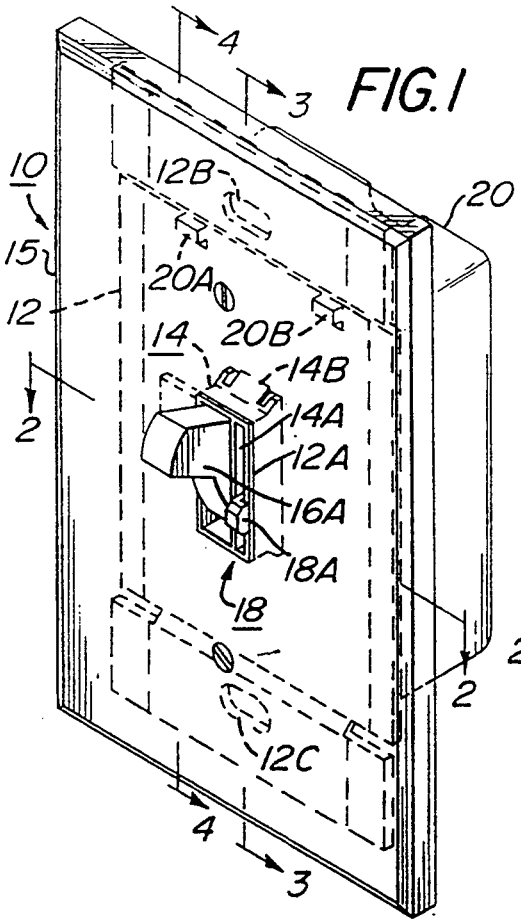
FIG. 1 is an isometric view of one embodiment of the wallbox-mountable switch of the present invention.

One embodiment of the present invention is depicted in FIG. 1, which is an isometric view of a switch and dimmer assembly 10. The assembly 10 may be of a wall-box-mountable type comprising a yoke 12, a toggle switch 16 having a handle 16A, a dimmer control 18 having a slidable arm with a member 18A for holding and adjusting and a backcover 20 for housing the elements that are interconnected to the toggle and dimmer switches 16 and 18, respectively, as well as the circuit elements to accomplish the dimming function. In practice, the yoke 12 is preferably covered by a wallbox faceplate 15. It is preferred that the assembly 10 also include a frame 14.

The yoke 12 has openings 12B and 12C which are used for connecting the yoke 12 to a standard wallbox housing (not shown). The yoke 12 has a central opening 12A. The central opening 12A has dimensions essentially corresponding to that of a standard type opening of the faceplate 15 which is of a rectangular shape and has dimensions of about 25 mm in height and about 12 mm in width. In one embodiment, the opening 12A is completely occupied by the toggle switch and a slidable am in a side-by-side arrangement. In another embodiment, the opening 12A is completely occupied by the toggle switch and two separate slidable arms also in a side-by-side arrangement. It is preferred that the toggle switch is substantially wider than the slidable arm or arms as in use the toggle switch will typically be adjusted much more frequently than the slidable arm or arms.

The toggle switch 16 can be operated by grasping the handle 16A with a thumb and forefinger or by flicking it up and down with just a forefinger. Hence, its operation is identical to that of a conventional general purpose toggle switch. This is particularly advantageous where the switch and dimmer assembly of the present invention is mounted in a multigang wallbox with conventional toggle switches as all the devices will operate in a similar manner.

The frame 14 has clamping arms 14B at opposite ends for engaging and affixing to opening 12A. Frame member 14 is sized to fit within a standard NEMA toggle switch opening which is defined by *NEMA Standards Publication/No. WD* 1-1979 on page 8 as having dimensions 0.925 (minimum) inches high by 0.406 inches wide. The frame member 14 completely occupies the opening 12A and has a channel 14A in which the arm 18 is slidable and from out of its frontal portion that the member 18A extends.

As shown in FIG. 1, the switch handle 16A and the channel 14A, having the member 18A, essentially and completely occupy the frontal portion of the frame 14. For another embodiment, devoid of frame 14, the toggle switch 16 and lever arm 18 are spaced apart from each other by a sufficient amount to avoid any interference in their respective movement while at the same time allowing both elements to snugly fit within opening 12A.

The toggle switch 16 of all embodiments uses an over-center spring bistable mechanism, to be further discussed with reference to FIG. 4, which functions such that during operation when movement of the handle passes the center position of the switch, a spring mechanism further assists the movement to reach the up (ON) or down (OFF) position. This type mechanism has a distinct tactile feel that notifies an operator when the desired switching is performed.

The slidable dimmer actuator 18 is preferably of the linear type in which the slider moves linearly along a predetermined path. This type is beneficial in that it permits lighting levels to be determined easily from its slider position which determination is particularly advantageous when the slidable control and lights being controlled are not visible from the control location. The slidable control 18 is preferably used to operate a linear potentiometer 22 housed within backcover 20.

The backcover 20 is affixed to yoke 12 by means of snap-fitting projections 20A and 20B and an attachment screw (not shown). The backcover 20 houses the mechanical coupling or interconnection of toggle switch 16 and microswitch 24, actuator 18 that cooperates with potentiometer 22, the dimmer circuitry, and other devices related to the present invention. The interconnection of control arm 18 to a potentiometer 22 that is used to adjust power to a load, as well as the interconnection of the handle 16A to means for turning power ON and OFF to a load, may be described with reference to FIG. 2 which is a view taken along line 2—2 of FIG. 1.

Figure 2:
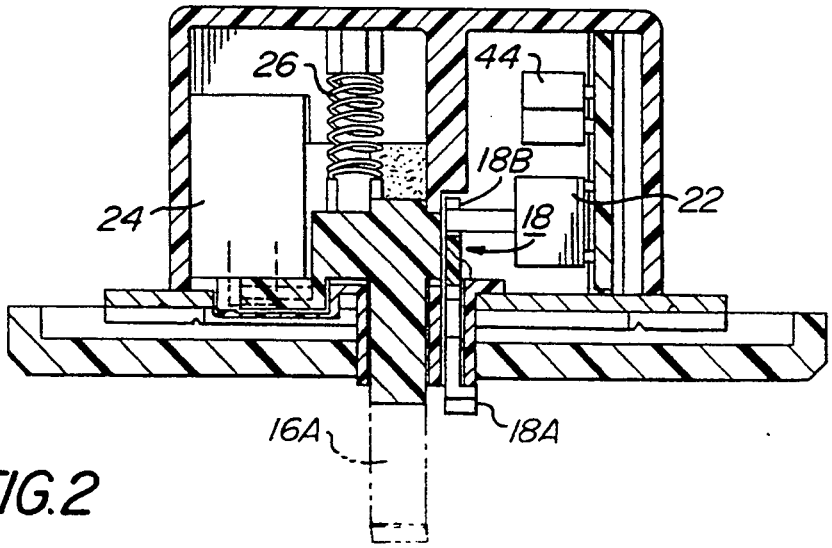
FIG. 2 is a view taken along line 2—2 of FIG. 1 showing the assembly of the toggle switch and slidable dimmer of the present invention.

FIG. 2 shows the arm 18 as being interconnected by bar member 18B to the means for adjusting the power to the load e.g., linear potentiometer 22. FIG. 2 further shows the handle 16A as being interconnected to the ON-OFF switching means, e.g., microswitch 24. The interconnection of member 18B to potentiometer 22 is further illustrated in FIG. 3 which is a view taken along line 3—3 of FIG. 1.

Figure 3:
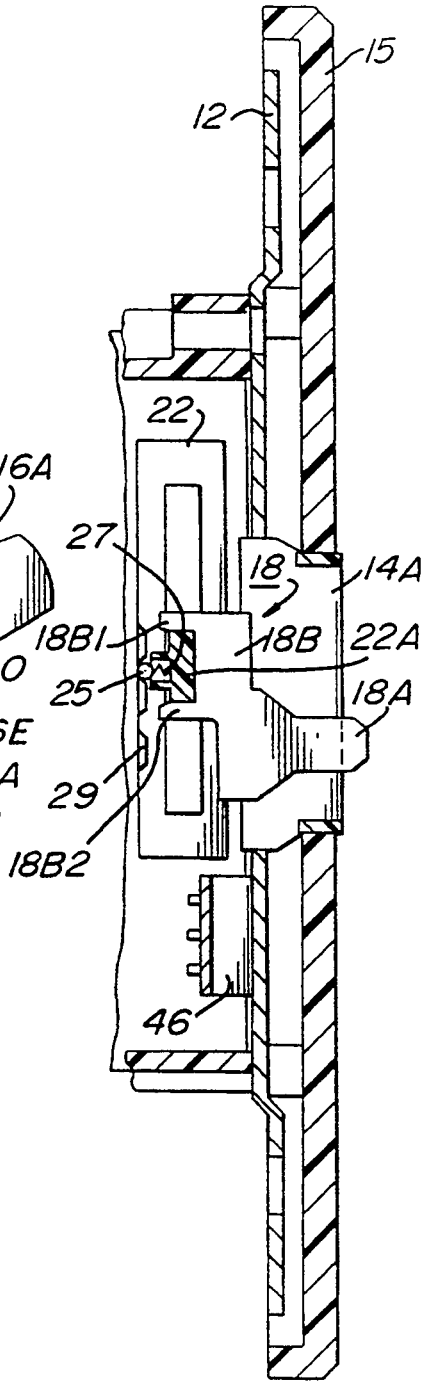
FIG. 3 is a view taken along line 3—3 of FIG. 1 showing details of the slidable lever of the present invention.

FIG. 3 shows bar member 18B as having outer portions 18B1 and 18B2 that are each positioned at and capture opposite sides of movable member 22A of the linear potentiometer 22. The movement of member 18A along a linear path within channel 14A correspondingly causes the movement of member 22A which, in turn, causes a corresponding increase or decrease in the variable resistance of potentiometer 22. The movement of toggle switch 16 which is of importance to the present invention may be described with reference to FIG. 4 which is a view taken along line 4—4 of FIG. 1.

Figure 4:
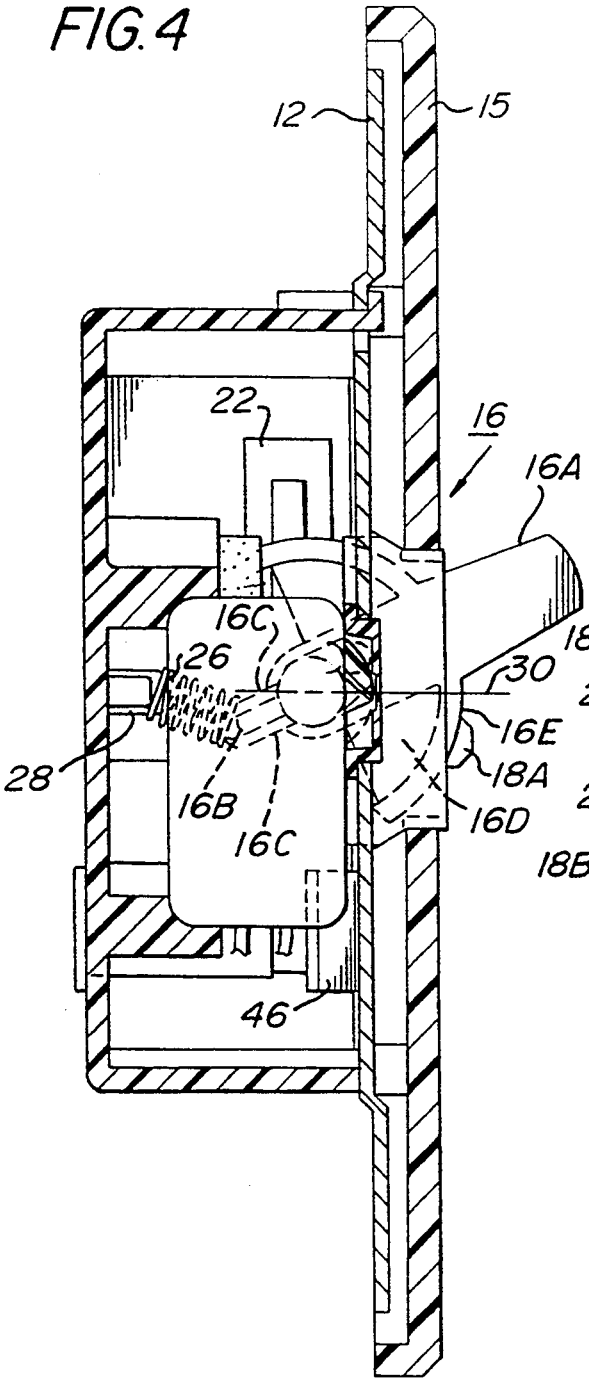
FIG. 4 is a view taken along line 4—4 of FIG. 1 showing details of the mechanical coupling of the toggle switch to a microswitch.

FIG. 4 shows the handle 16A as interconnected to a rearwardly projecting portion 16B having rail portions 16C each of which mates with one end of the previously mentioned over-center spring 26 which has its other end mating with retaining means 28 that is affixed to the backcover 20. The handle 16A and rear portion 16B are blended together by a central portion 16D of toggle switch 16 having an outer arc-like shaped portion 16E. The toggle 16 rotates about a centerline 30 shown in FIG. 4.

In operation, as handle 16A is moved so as to rotate about centerline 30, the rails 16C engage spring 28, and when the central region of the handle 16A approaches the centerline 30, the spring imparts a force to the rails 16C which assists in the further movement of handle 16A to its fully up (ON) or fully down (OFF) position. The ON and OFF positions control the operation of the microswitch 24 and may be described with reference to FIG. 5.

Figure 5:
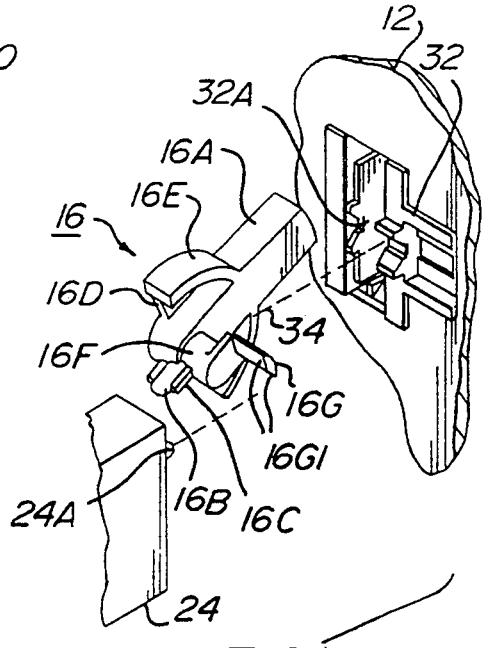
FIG. 5 shows further details of the interconnection of the toggle switch to the microswitch and the yoke of the wallbox-mountable switch.

FIG. 5, shown partially in section, is an exploded perspective view illustrating the toggle 16 spaced apart from the microswitch 24 and a cradle 32. The cradle 32 is affixed to the yoke 12 and has a central region 32A having dimensions that are complementary to an axial portion 16F of the toggle 16. The axial portion 16F is mated with the central region 32A along line 34 shown in FIG. 5. The cradle 32 provide the means for housing toggle switch 16 to the yoke 12.

The toggle handle 16, more particularly, an extension member 16G mates with the microswitch 24 along line 36 shown in FIG. 5. The member 16G has inwardly curved portions 16G1 located on toggle switch 16 in a predetermined manner so as to mate with actuator 24A of microswitch 24 when the toggle switch 16 is moved to its ON or OFF position. The actuator 24A controls the switching of the microswitch 24.

Figure 6:
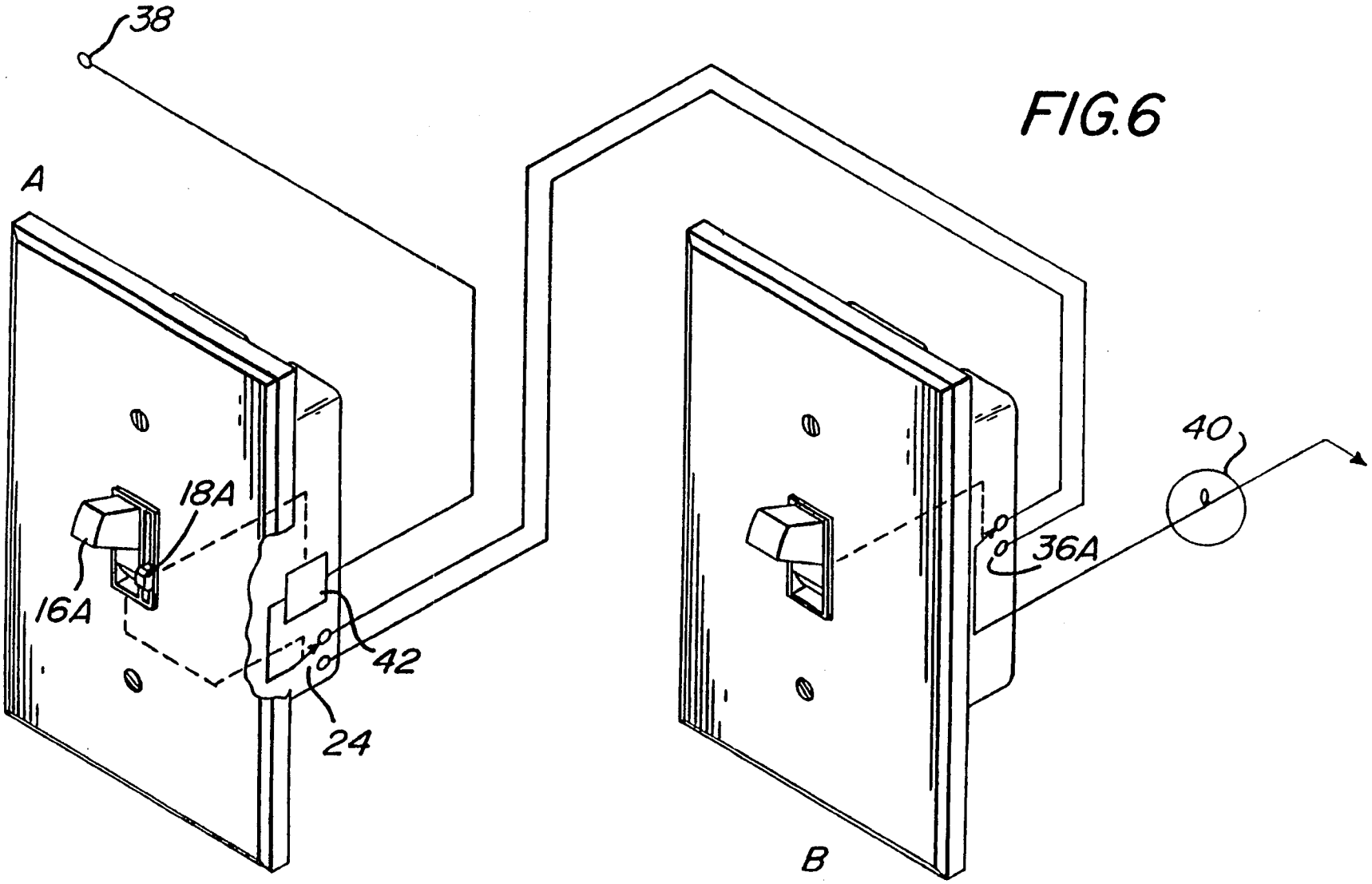
FIG. 6 is a functional representation of an arrangement of particular importance to the present invention to accomplish both three-way ON-OFF switching and dimming.

A primary feature of the present invention is to provide for independent three-way ON-OFF switching and dimming control from a toggle switch type of dimmer comprising the assembly 10. FIG. 6 illustrates an assembly 10 providing station A and a standard three-way switch 36, having contacts 36A, providing station B. Each of the stations A and B controls (ON-OFF) the excitation 38 supplied to a lamp 40. The assembly 10 of station A further includes dimmer circuit 42 for adjusting the amount of power applied to the load 40. The dimmer circuit 42 comprises various components some of which 44 and 46 are respectively shown in FIGS. 3 and 4. The dimmer circuit 42 may be that disclosed in the RCA Thyristor and Rectifier Manual, published in 1975 on page 229 which is herein incorporated by reference.

In operation, the amount of power supplied to the load 40 may be controlled by station A. Further, each station A or B has the ability to separately and independently control the ON-OFF state of the load 40.

The switching described with reference to FIG. 6 may also be obtained by the arrangement of the wall-box-mountable switch of the previously mentioned U.S. patent application Ser. No. 225,457; however, not with the same benefits of the present invention. The primary difference between the Ser. No. 225,457 and the present invention being the toggle switch 16.

The practice of the present invention further provides for means that prevent the inadvertent movement of the dimming control 18 during the operation of the toggle switch 16 and which may be described with reference to one embodiment shown in FIG. 7.

Figure 7:
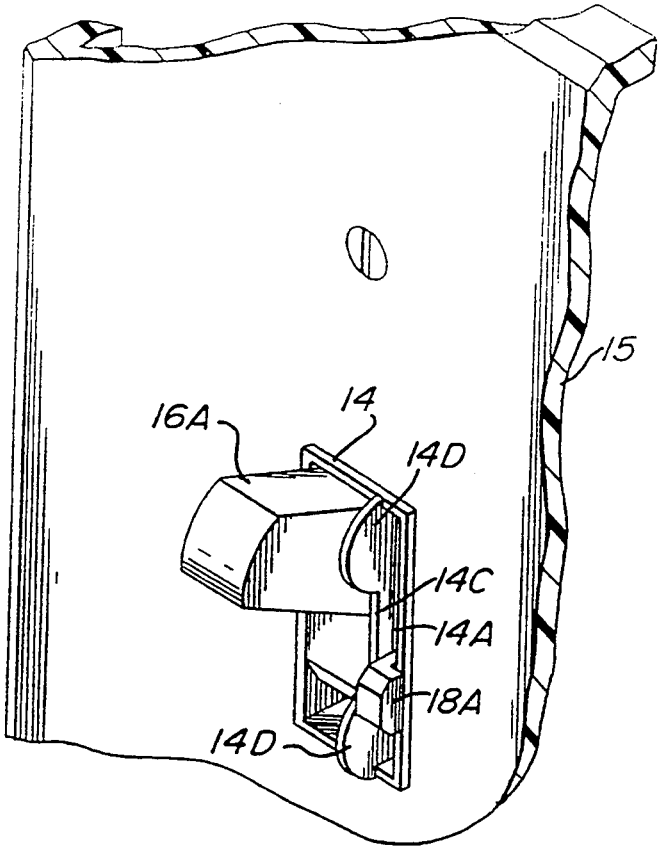
FIG. 7 is an embodiment of the present invention that prevents the inadvertent movement of the linear dimmer switch of the present invention.

FIG. 7 is partially in section showing the faceplate 15 enlarged relative to FIG. 1. FIG. 7 shows a frame 14 in which the channel 14A is partially formed by a wall having a top surface 14C adjacent to but not interfering with the path of travel of member 18A. The top surface 14C has at least one pertuberance 14D, but preferably two located at opposite ends of the path of travel of member 18A. The pertuberances 14D have a height dimension that exceed the height of the member 18A. The pertuberances or bumps 14D are located in the upper and lower regions in which the switch handle 16A is likely to be contacted during its operation which, in turn, may inadvertently cause the handle 18A to be moved during such operation. The pertuberances 14D serve as means to safeguard the preset condition of the dimming control during the operation of toggle handle 16A.

A further embodiment of the present invention that prevents inadvertent movement of the lever arm 18 includes detents 29 on the linear potentiometer to inhibit inadvertent movement. The detents 29 may be placed along the path of movement and the arm may have ball-like member 25 that cooperates via spring means 27 with the detents 29 so as to only allow intentional movement of the arm.

Figure 8:
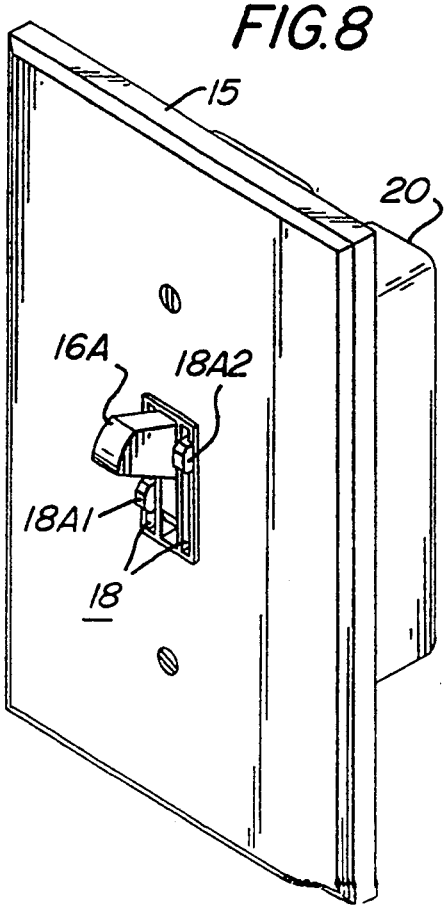
FIG. 8 is an isometric view of a wallbox-mountable switch of the present invention having dual means for adjusting power to electrical loads.

Another embodiment of the present invention is illustrated in FIG. 8 which is similar to FIG. 1 except for its showing of members 18A1 and 18A2 that are advantageously used for various control means. In one embodiment envisioned by the present invention, the control member 18A1 may be used for adjusting the intensity level of lamps within a room, such as a bathroom, whereas, the other control member 18A2 may be used to control the speed of the motor of a fan within such a bathroom.

The control members 18A1 and 18A2 may be used to preset the illumination level and speed, respectively, and these preset illumination and speed positions are activated or deactivated by the movement of switch handle 16A to its ON or OFF position. Control members 18A1 and 18A2 can control potentiometers, or control member 18A1 can control a potentiometer, and control member 18A2 can control a multiposition switch used for motor speed control applications.

Figure 13:
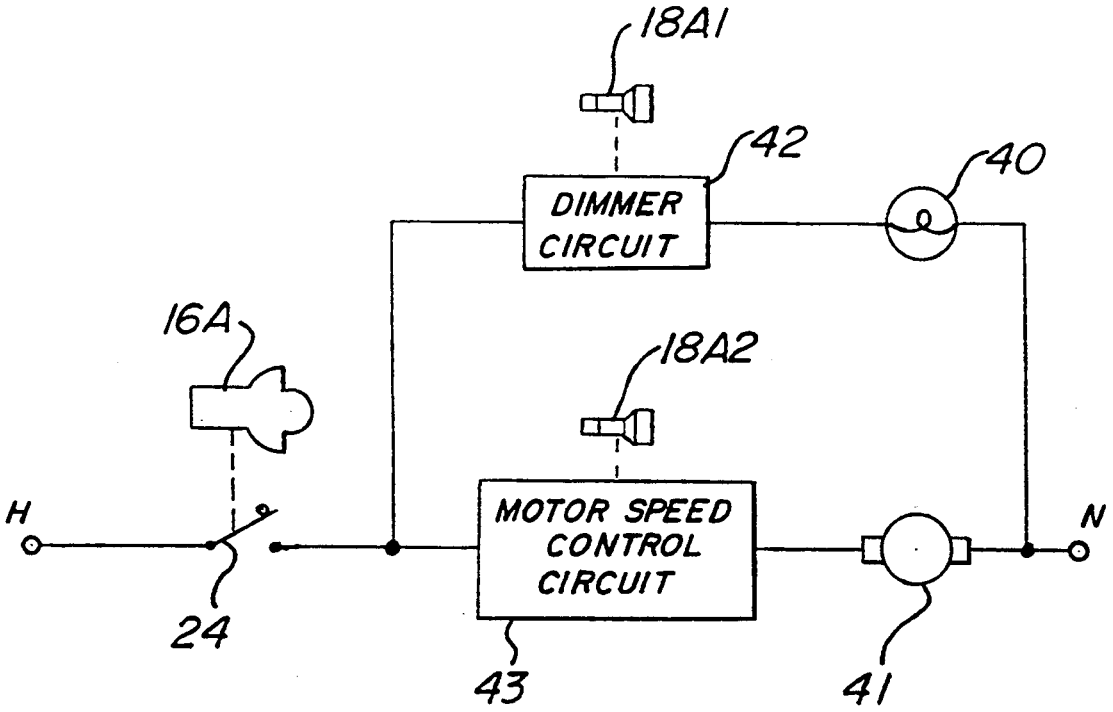
FIG. 13 is a circuit block diagram of a circuit which can be used with the switch and dual adjusting means or FIG. 8.

As is further illustrated in FIG. 13, switch handle 16A operates switch 24 which connect both dimmer circuit 42 and motor speed control circuit 43 to the hot terminal (H) of the supply when switch 24 is in the ON position.

Dimmer circuit 42 controlling lamp 40 may be that disclosed in the *RCA Thyristor and Rectifier Manual,* published in 1975, on page 229 which is herein incorporated by reference, and control member 18A1 controls the potentiometer within that circuit. Motor speed control circuit 43 controlling motor 41 may be that disclosed in the *RCA Thyristor and Rectifier Manual,* published in 1975, on page 238 which is herein incorporated by reference and control member 18A2 controls the potentiometer within that circuit.

Alternatively, motor speed control circuit 43 may be that disclosed in the commonly assigned U.S. Pat. No. 5,293,103, herein incorporated by reference and control member 18A2 controls the multiposition switch within that circuit.

Figure 9:
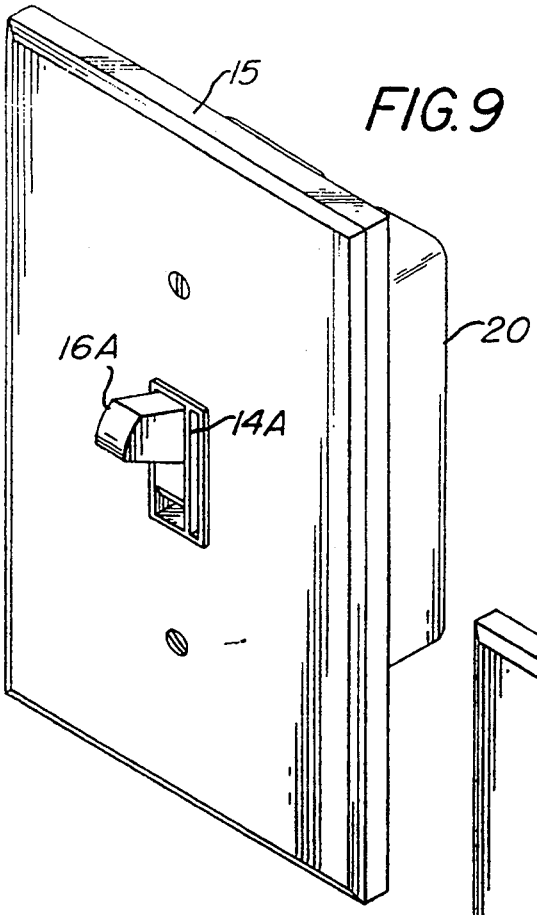
FIG. 9 is still a further embodiment of a wall-box-mountable switch that is particularly suited for energy-management applications.

A further embodiment related to the present invention that is particularly suited for energy management considerations is illustrated in FIG. 9. The frame 14 has provided therein a channel 14A, previously discussed with regard to FIG. 1, that has a sliding member 18A which does not extend out of channel 14A. Channel 14A provides a passageway for the insertion of a tool to set sliding member 18A, and hence, the means for adjusting power to a load to a particular position so that the power applied to a load, such as lamp 40 of FIG. 6, remains fixed at the preset position, but responsive to the ON/OFF control provided by handle 16A, and can only be further adjusted by the use of a tool.

Figure 10:
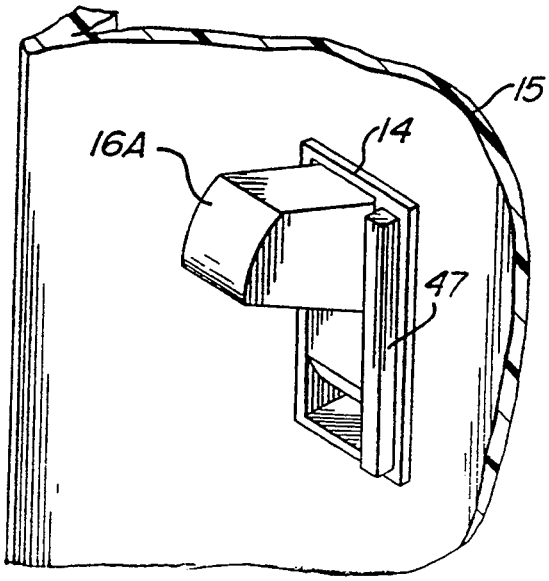
FIG. 10 is another embodiment particularly suited for energy-management applications.

Another embodiment is shown in FIG. 10 which is similar to FIG. 9 except for the showing of the frame 14 in an enlarged manner and for faceplate 15 partially in section. The embodiment of FIG. 10 also finds use for energy management applications. FIG. 10 shows a removable plug 46 which prevents access to the slidable arm 18. In operation, the plug 46 is removed and the lever arm is adjusted to a desired preset position and then plug 46 is replaced. This helps to ensure that slidable arm 18 remains at the preset position.

Figure 11A:
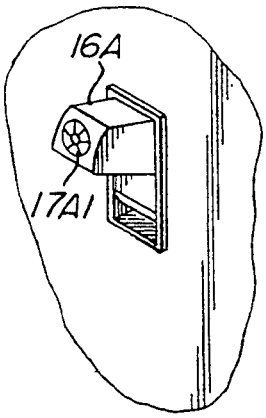
FIGS. 11*a*, 11*b* and 11*c* show embodiments of the invention that use rotatable dimmer actuators.
Figure 11B:
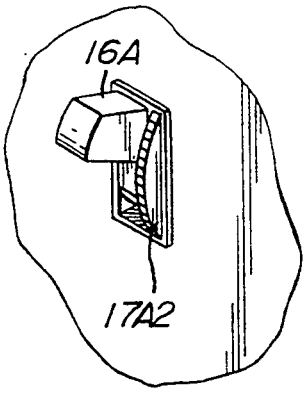
Figure 11C:
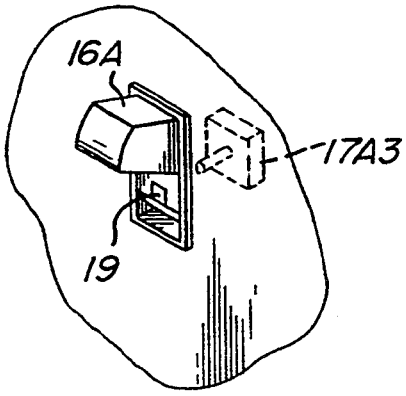

Further embodiments of the invention are shown in FIGS. 11*a*, 11*b* and 11*c*. Each of these embodiments include switch handle 16A of FIG. 1 to control the ON/OFF switching of the load. However sliding member 18A has been replaced with rotatable members 17A1, 17A2, and 17A3 respectively shown in FIGS. 11*a*, 11*b* and 11*c*.

FIG. 11*a* shows rotatable member 17A1 located on the end of handle 16A. The rotatable member 17A1 is coupled to a rotary potentiometer by a flexible coupling (not shown). Adjustment of rotatable member 17A1 varies the setting of the rotary potentiometer and through the dimming circuit the amount of power delivered to the load.

FIG. 11*b* shows rotatable member 17A2 located alongside handle 16A. Rotatable member 17A2 is coupled to a rotary potentiometer (not shown). Adjustment of rotatable member 17A2, preferably using a thumb, varies the setting of the rotary potentiometer and through the dimming circuit the amount of power delivered to the load.

FIG. 11*c* includes rotatable member 17A3 (shown in phantom) accessible through opening 19 in toggle 16, by using a tool. Rotatable member 17A3 is only accessible when toggle 16 is in the up or ON position. Adjustment of rotatable member 17A3 using a tool varies the setting of the rotary potentiometer and through the dimming circuit the amount of power delivered to the load.

Figure 12:
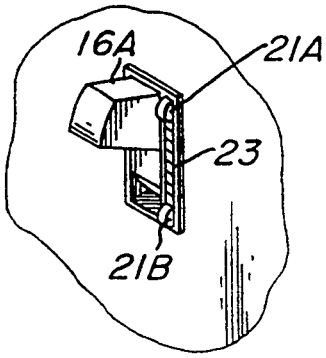
FIG. 12 shows an embodiment of the invention which includes raise and lower push buttons as dimmer circuit actuators.

Another embodiment of the invention is shown in FIG. 12. This embodiment includes the switch handle 16A of FIG. 1 to control the ON/OFF switching of the load. However, sliding member 18A has been replaced with push button actuators 21A and 21B and LED bar graph display 23. Depressing push button actuator 21A causes the amount of power supplied to the load to increase. In like fashion, depressing push button actuator 21B causes the amount of power supplied to the load to decrease. The amount of power being supplied to the load can be displayed using LED bar graph 23 in a known manner. A dimming circuit suitable for interfacing with push buttons 21A and 21B is disclosed in the *Signetics*, Philips professional analog IC handbook IC603-83, on page 235, using the *Signetics* TEA 1010 integrated circuit.

The present invention may be embodied in other specific forms without departing from the spirit or essential attributes thereof and, accordingly, reference should be made to the appended claims, rather than to the foregoing specification, as indicating the scope of the invention.

We claim:

1. A mechanism for controlling the ON/OFF state of an electrical switch and the operation of a dimming device, both electrical switch and dimming device being contained by a wall box and collectively operating to control the level of power supplied to an electrical load, said mechanism comprising:

(a) a manipulatable toggle switch actuator;

(b) a manipulatable dimmer actuator;

(c) a frame for (i) supporting said dimmer actuator for movement in a second plane substantially parallel to said first plane, a portion of said frame defining first and second, side-by-side. rectangular openings in which said actuators are movable; and (d) a support member for supporting said frame so that (i) said toggle switch actuator is operatively connected to said electrical switch, (ii) said dimmer actuator is operatively connected to said device, and (iii) said actuators extend through an opening in a wall box faceplate.

2. The mechanism as defined by claim 1 wherein one of said rectangular opening functions to guide the movement of said dimmer actuator.

3. The mechanism as defined by claim 1 further comprising a second manipulatable dimmer actuator for controlling the operation of a second dimming device contained by said wall box, said second dimming device being adapted to control power supplied to a second electrical load, and wherein said frame defines a third channel within which said second dimmer actuator is movable.

4. The mechanism as defined by claim 1 wherein said third rectangular opening is parallel to said first and second channels.

5. The mechanism as defined by claim 1 wherein said frame is releasably connected to said support member.

6. The mechanism as defined by claim 1 wherein said channels are of substantially equal length.

7. The mechanism as defined by claim 1 wherein the movement of said dimmer actuator is a sliding movement from one end of one said rectangular opening to the respective other end.

* * * * *

UNITED STATES PATENT AND TRADEMARK OFFICE

CERTIFICATE OF CORRECTION

PATENT NO. : 5,359,231

DATED : October 25, 1994

INVENTOR(S) : Woodie C. Flowers, et al

It is certified that error appears in the above-indentified patent and that said Letters Patent is hereby corrected as shown below:

Col. 1, line 39, should read --April 21, 1992--
Col. 1, line 48, should read --Ser. No. 07/871,876--.
Col. 3, line 40, should read --arm in a side-by-side arrangement. In another embodi--
Col. 5, lines 48 and 50, change "Ser. No. 225,457" to read --Ser. No. 07/871,876--

Column 8 Claim 1, line 9 should read --(c) a frame for (i) supporting said toggle switch actuator for limited rotational movement in a first plane, and (ii) supporting said dimmer actuator for--
Column 8 Claim 2, line 2 should read --of said rectangular openings functions to guide the--
Column 8 Claim 3, line 7 should read --rectangular opening within which said second dimmer actuator is--
Column 8 Claim 4, line 3 should read --second rectangular openings--
Column 8 Claim 6, line 2 should read --rectangular openings are of substantially equal length.--

Signed and Sealed this

Second Day of May, 1995

*Attest:*

Bruce Lehman

BRUCE LEHMAN

*Attesting Officer*

*Commissioner of Patents and Trademarks*